United States Patent [19]

Schaad

[11] 3,940,585

[45] Feb. 24, 1976

[54] HEAVY DUTY PUSH-BUTTON ELECTRICAL SWITCH

[75] Inventor: William J. Schaad, Winnetka, Ill.

[73] Assignee: Indak Manufacturing Corporation, Northbrook, Ill.

[22] Filed: May 13, 1974

[21] Appl. No.: 469,056

[52] U.S. Cl. ..... 200/159 R; 200/16 C; 200/153 V

[51] Int. Cl.[2] ..... H01H 13/52

[58] Field of Search ..... 200/153 V, 159 R, 302, 200/243, 165, 16 A, 16 B, 16 C, 16 D

[56] References Cited

UNITED STATES PATENTS

| | | | |
|---|---|---|---|
| 1,132,997 | 3/1915 | Apple | 200/159 X |
| 3,172,974 | 3/1965 | Perrino | 200/243 X |
| 3,408,464 | 10/1968 | Earleywine, Jr. et al. | 200/159 R X |
| 3,586,810 | 6/1971 | Brown | 200/159 R X |

OTHER PUBLICATIONS

Holm, Electrical Contacts Handbook, 3rd Edition, 1958.

Holm, Electrical Contacts, 1946.

*Primary Examiner*—Robert K. Schaefer
*Assistant Examiner*—William J. Smith
*Attorney, Agent, or Firm*—Burmeister, Palmatier & Hamby

[57] ABSTRACT

A heavy duty push-button switch for the direct closing and opening of a high-current electrical circuit, such as the starter motor circuit for an internal combustion engine, comprising a casing containing at least two contact points engageable by a contactor disk mounted on a movable carriage member. The contactor disk is freely rotatable on the carriage member when the contactor disk is in transit between the contact points and a backstop. The contact points are preferably made of a silver alloy. Moreover, at least the surface portion of the contactor disk, presented to the contact points, is made of a silver alloy. The transfer of silver is equalized in both directions between the disk and the contact points. The switch preferably includes first spring means for biasing the contactor disk against the backstop. The switch has a movable push-button, and second spring means disposed between the push-button and the carriage member to move the contactor disk into engagement with the contact points, against the biasing action of the first spring means. The push-button is hollow with an opening within which the carriage member is telescopically slidable.

16 Claims, 7 Drawing Figures

HEAVY DUTY PUSH-BUTTON ELECTRICAL SWITCH

This invention relates to a heavy duty pushbutton switch which may be employed very advantageously for directly completing and interrupting a high current electrical circuit, such as the starter motor circuit for an internal combustion engine.

In one advantageous application, two push-button switches are employed in the starter motor circuit for an outboard boat motor. One push-button switch is manually operable to complete the starter motor circuit so as to turn over the motor. The other push-button switch may function as a neutral safety switch, which is closed when the transmission for the motor is in neutral, but is opened when the transmission is shifted from its neutral position into one of its driving positions. In both cases the push-button switch must be capable of handling the full starter motor current, which may amount to 50 or 60 amperes, or even more, for example.

Heretofore, it has been the common practice to use solenoid operated switches in the starter motor circuit for an internal combustion engine. However, such switches are expensive and bulky. The push-button switch of the present invention is much more economical and compact.

Thus, one object of the present invention is to provide a new and improved heavy duty electrical switch which is fully capable of completing and interrupting a high current electrical circuit, yet is inexpensive and compact.

A further object is to provide such a new and improved heavy duty push-button switch which is capable of giving highly dependable service for a great many cycles of operation, so that the switch will normally last for the entire life of the internal combustion engine.

In accordance with the present invention, the push-button switch preferably comprises at least two contact points mounted in a casing. A contactor disk is engageable with the contact points and is mounted on a carriage member which is linearly movable within the casing. Preferably the contactor disk is freely rotatable on the carriage member, so that the contactor disk will be freely rotatable when it is in transit between the contact points and a backstop, against which the contactor disk is biased by first spring means. Vibration and other environmental factors cause rotation of the contactor disk when it is in transit, so that the contactor disk presents fresh surfaces to the contact points during repeated cycles of use. The engagement between the contactor disk and the backstop prevents the contactor disk from being shaken loose by heavy vibration, even over a long period of time. When the switch is mounted on an outboard motor or some other internal combustion engine, it is subject to such vibration.

At least the tip portions of the contact points are preferably made of a silver alloy, so that the switch will be capable of handling and interrupting a heavy current. At least the surface of the contactor disk, as presented to the contact points, is also preferably made of a silver alloy. Due to the random rotation of the contactor disk, the transfer of silver is equalized between the contactor disk and the contact points.

The switch includes a push-button which preferably is arranged with second spring means between the push-button and the carriage member. When the push-button is actuated, the biasing force of the first spring means is overcome by the second spring means. The bush-button and the carriage member are preferably telescopically related. Thus, the push-button may be hollow with an opening in which the carriage member is telescopically slidable. The second spring means may take the form of a coil spring which is disposed in the hollow push-button and is compressible between the push-button and the carriage member. The outward movement of the push-button is preferably limited by stop means on the push-button and the casing. Such spring arrangement provides for over-travel of the push-button, which is an important advantage when the push-button is mechanically operated, which is the case when the push-button switch is employed as a neutral safety switch.

Further objects, advantages and features of the present invention will aappear from the following description, taken with the accompanying drawings in which.

As just indicated, the drawings illustrate a push-button switch 10 which is well adapted for heavy duty service as in the starter motor circuit 12 for an internal combustion engine, for example.

Figure 6:
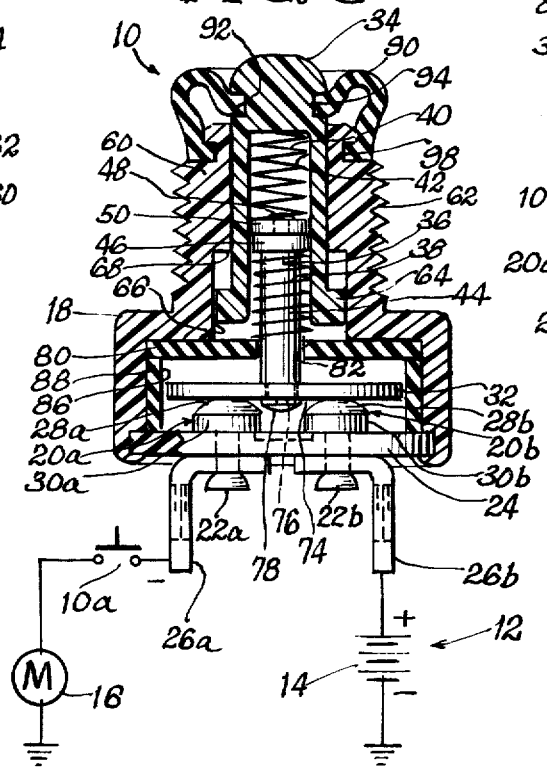
FIG. 6 is a view similar to FIG. 5 but showing the switch in its closed position to complete an electrical circuit.

As illustrated in FIG. 6, the switch 10 may be connected in series with the starter motor circuit 12 which also comprises a battery 14 and a starter motor 16. The circuit 12 preferably includes a second push-button switch 10a which may be the same as or very similar to the switch 10. As previously indicated, one of the push-button switches, such as the switch 10, may be manually operable to close the motor circuit 12 so as to energize the motor 16, which is then effective to turn over the internal combustion engine. The other push-button switch such as the switch **10*a*, may be employed as a neutral safety switch which is closed when the transmission is in its neutral position while being opened when the transmission is shifted to any of its driving positions. The neutral safety switch 10*a* prevents the starting of the internal combustion engine when the transmission is not in its neutral position. Moreover, the neutral safety switch tends to prevent the actuation of the starter motor 16** when the internal combustion engine is running.

The illustrated switch 10 comprises a casing 18, which may be made of a resinous plastic material, or any other suitable material. At least two contact points **20*a* and *b* are mounted in the casing 18. In this case, the contact points 20*a* and *b* are in the form of rivets 22*a* and *b* extending through and secured to a terminal head or plate 24, preferably made of an electrically insulating material which is highly resistant to heat. An example of such a material is Bakelite, which is a paper reinforced heat setting phenolic resin, preferably coated on both sides with a heat resistant melamine plastic material. Terminal lugs or prongs 26***a* and *b* are secured to the rivets 22*a* and *b*.

The illustrated contact points 22*a* and *b* have spherically rounded tip portions 28*a* and *b* which are preferably made of a metal material having an extremely high electrical conductivity, such as silver or a silver alloy which is composed predominantly of silver. Copper may also be employed. While it is highly advantageous to make the tip portions 28*a* and *b* out of silver alloy, the base portions 30*a* and *b* of the contact points 20*a* and *b*, and also the rivets 22*a* and *b*, may be made of a less expensive material, such as copper, which is also highly conductive. The base portions 30*a* and *b* may take the form of heads formed integrally with the rivets 22*a* and *b*. The silver alloy tip portions 28*a* and *b* may be welded, brazed or otherwise secured to the base portions 30*a* and *b*.

Figure 1:
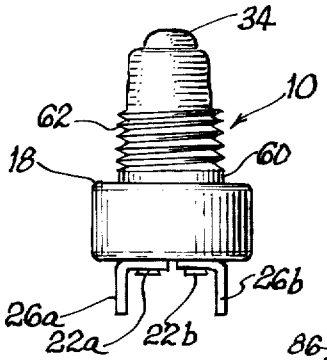
FIG. 1 is a side view of a push-button switch to be described as an illustrative embodiment of the present invention.
Figure 2:
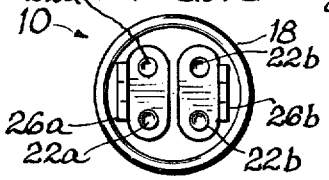
FIG. 2 is a rear view of the switch.
Figure 3:
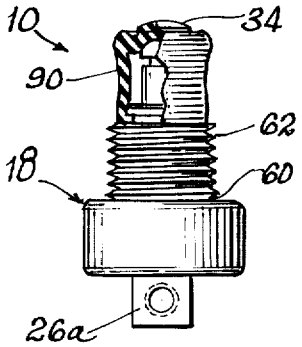
FIG. 3 is another side view, taken at right angles to the view of FIG. 1.
Figure 4:
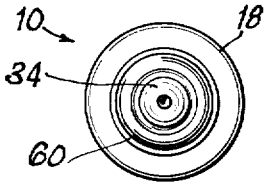
FIG. 4 is a front view of the switch.
Figure 5:
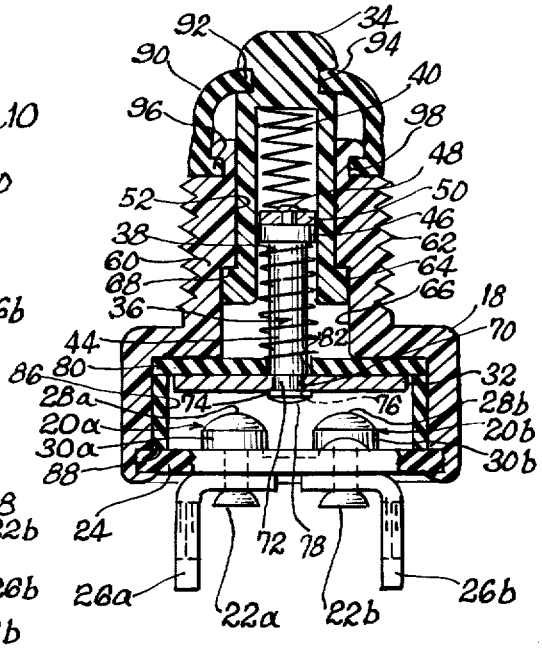
FIG. 5 is an enlarged longitudinal section with the switch in its open position.

The casing 18 also contains a conductive contactor 32 which is movable into and out of engagement with the contact points 22*a* and *b*. In FIG. 5, the contactor 32 is shown in its disengaged position. In FIG. 6, the contactor has been moved against the contact points 22*a* and *b* so as to complete the electrical circuit therebetween. In this way, the starter motor 16 is energized assuming that the neutral safety switch 10*a* is closed.

A push-button 34 is preferably provided to operate the contactor 32. Depressing the push-button 34, as shown in FIG. 6, causes the contactor 32 to move against the contact points 22*a* and *b*.

The illustrated contactor 32 is mounted on a carriage member 36 which is movable within the casing 18 along a linear path. The carriage member 36 is biased by first spring means 38 which may take the form of a compression coil spring, arranged to bias the contactor 32 away from the contact points 22*a* and *b*. The connection between the push-button 34 and the carriage member 36 may utilize second spring means 40, preferably in the form of a second compression coil spring which is adapted to be compressed when the push-button 34 is depressed. The force thus developed by the second spring 40 is sufficiently great to overcome the biasing action of the first spring 38, so that the contactor 32 is moved against the contact points 22*a* and *b*.

Preferably, the push-button 34 and the carriage member 36 are telescopically movable, one within the other. In this case, the push-button 34 is hollow and is formed with a cylindrical opening 42, within which the carriage member 36 is telescoped. As illustrated, the carriage member 36 comprises a generally cylindrical shaft or pin 44 having an enlarged portion 46 which is slidable within the opening 42 in the push-button 34. The illustrated carriage member 36 has a reduced upper end portion 48 on which an electrically insulating washer 50 is mounted.

The spring 40 may be disposed within the opening 42 in the push-button 34, so as to be compressible between the push-button and the washer 50 on the carriage member 36.

The push-button 34 is slidably mounted in the casing 18. As shown, the push-button 34 is slidably received within a cylindrical opening 52 formed in a reduced front portion 60 on the casing 18. The illustrated front portion 60 is formed with screw threads 62 to receive a mounting nut or some other fastener not shown.

The illustrated push-button 34 has an enlarged rear portion 64 which is slidable within an enlarged opening 66 communicating with the rear end of the opening 52. The enlarged portion 64 acts as a stop element to engage a shoulder 68 within the casing 18, so as to limit the outward movement of the push-button 34. Initially, the springs 38 and 40 are effective to bias the enlarged portion 64 against the shoulder 68.

As previously indicated, the contactor 32 is preferably in the form of a circular disk which is mounted on the rear end of the carriage member 36. The mounting of the disk 32 is preferably such as to permit the free rotation of the contactor disk 32 relative to the carriage member 36. Thus, the illustrated disk 32 has a central circular opening 70 which is loosely fitted around a reduced rear portion 72 of the carriage member 36.

In the assembly of the carriage member 36 and the contactor disk 32, the disk is slipped over the reduced rear portion 72 and then a washer 74 is slipped over a still further reduced end portion 76. Finally, the end portion 76 is riveted or upset, as indicated at 78, to retain the washer 74 and the contactor disk 32.

The fit between the contactor disk 32 and the carriage member 36 is sufficiently loose to provide for a slight rocking movement of the contactor disk 32, as well as free rotation thereof, so that the disk 32 will align itself with the contact points 20*a* and *b*. In this way, the contact pressure will be equalized between the contactor disk 32 and the contact points 20*a* and *b*.

The contactor disk 32 is free to rotate when it is in transit between its initial position, as shown in FIG. 5, and its actuated position, as shown in FIG. 6, in which the disk engages the contact points 20*a* and *b*. The engagement between the disk 32 and the contact points 20*a* and *b* prevents rotation of the disk when the switch is closed.

It is preferable to provide means for preventing rotation of the contactor disk 32 when the switch is in its initial position, as shown in FIG. 5. In the illustrated switch 10, this result is achieved by providing a backstop 80 which is engaged by the disk 32 when the push-button 34 is released. The backstop 80 may take the form of a wall member in the casing 18. In this instance, the backstop 80 is a separate piece in the form of an insulating disk, mounted within the casing 18. The illustrated backstop disk 80 has a central opening 82 through which the carriage member 36 is slidable. The contactor 32 is movable between the backstop disk 80 and the contact points 20*a* and *b*. In this instance, the coil spring 38 is compressed between the backstop disk 80 and the enlarged portion 46 of the carriage member 36. The coil spring 38 is received around the carriage member 36.

In the illustrated switch 10, the backstop disk 80 is mounted at the front end of a cylindrical cavity or opening 86 formed within the casing 18. A cylindrical bushing 88 is mounted within the opening 86, between the backstop disk 80 and the terminal head 24. The backstop disk 80 and the sleeve 88 are preferably made of heat-resistant resinous plastic materials.

It is preferred to provide a flexible resilient boot 90 between the push-button 34 and the casing 18, to act as a seal, so as to exclude moisture, dust and the like from the switch. In this case, the boot 90 is made of natural or synthetic rubber, or some other suitable flexible material. It will be seen that the boot 90 is generally cup-shaped and is formed with an inwardly projecting annular flange 92 at its front end, adapted to be received in an annular groove 94 formed in the push-button 34. Another annular flange 96 projects inwardly at the rear end of the boot 90 and is adapted to be received in an annular groove 98 in the front end of the casing 18.

Figure 7:
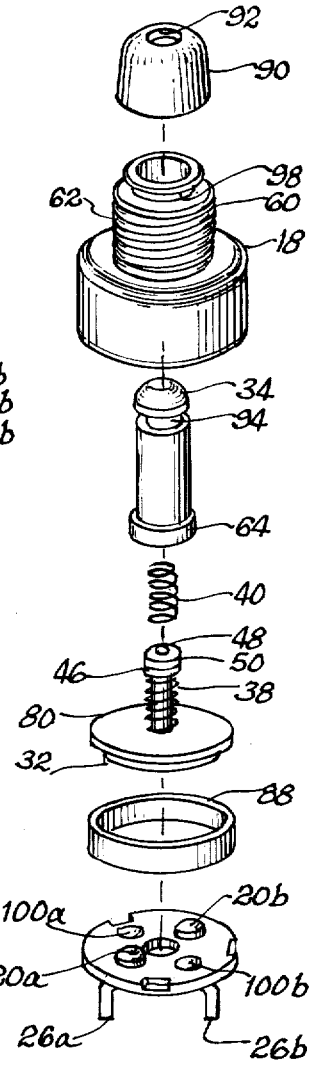
FIG. 7 is an exploded or disassembled view of the switch.

FIGS. 5 and 7 show the initial shape of the boot 90. When the push-button 34 is depressed, the boot 90 is flexed in the manner shown in FIG. 6.

In addition to the rivets 22*a* and *b* which are formed integrally with the contact points 20*a* and *b*, it is preferred to employ rivets 100*a* and *b* to secure the terminal lugs 26*a* and *b* to the terminal head or plate 24.

The switch 10 is operated by depressing the pushbutton 34, either manually or mechanically. When the switch is used as a starter switch it will be depressed manually. When the switch is used as a neutral safety switch the push-button 34 may be operated mechanically by a cam or the like, associated with the selector device of the transmission.

When the push-button 34 is depressed, as shown in FIG. 6, the coil spring 40 is compressed. The added force developed in the spring 40 is applied to the carriage member 36 and is effective to overcome the biasing action of the spring 38 so that the carriage member 36 is moved rearwardly. In this way, the contactor disk 32 is brought into engagement with the contact points 20*a* and *b*. In this way, an electrical circuit is established between the contact points.

The provision of the switch 40 makes it possible for the push-button 34 to travel a considerably greater distance than the distance through which the contactor 32 is moved. This ability to accept over-travel is important when the push-button 34 is mechanically operated.

When the push-button 34 is released, it is returned outwardly by the springs 38 and 40. The contactor 32 is moved away from the contact points 20*a* and *b* and is returned into engagement with the backstop 80, as shown in FIG. 5.

Due to the free rotatable mounting of the contactor disk 32 on the carriage member 36, the contactor disk is free to rotate when it is in transit between the backstop 80 and the contact points 20*a* and *b*. This arrangement is highly advantageous because random rotation will be imparted to the contactor disk 32 by vibration, vehicle movement and other environmental factors. Thus, the contactor disk 32 will not always present the same surface elements to the contact points 20*a* and *b*. Instead, the contactor disk 32 will present fresh surface elements to the contact points during repeated cycles of use. Thus, the wear on the contactor disk 32 will be distributed around the disk.

The engagement of the contactor disk 32 with the backstop 80 prevents the rotation of the contactor disk 32 when the push-button 34 is released, as shown in FIG. 5. Vibratory movement of the contactor disk 32 is also prevented. Thus, the switch is able to withstand heavy vibration over a long period of time. In the absence of the restraint provided by the backstop 80, heavy vibration might tend to shake the contactor disk 32 loose from the carriage member 36. Thus, the switch is well suited for applications in which it is mounted directly upon an outboard motor or some other internal combustion engine.

As previously indicated, at least the tip portions 28a and b of the contact points 20*a* and *b* are preferably made of silver or a silver alloy, so as to increase the current handling capacity of the switch. Similarly, at least a portion of the contactor disk 32 is preferably made of silver or an alloy composed predominately of silver, such as the previously described alloy. The silver portion is preferably provided on the surface of the contactor disk 32 which is presented to the contact points 20*a* and *b*. Specifically, this portion of the contactor disk 32, or the entire disk, may be silver plated.

Erosion of the contact points 20*a* and *b* tends to occur during normal use of the switch, due primarily to the arcing which occurs when the current is interrupted. The erosion is greater at the contact point which is given a positive polarity in the electrical circuit because the silver tends to be transferred from the positive contact point to the contactor disk 32. On the other hand, at the other contact point, the silver tends to be transferred from the contactor disk 32 to the negatively polarized contact point.

Due to the fact that the contactor disk 32 rotates freely in a random manner when the disk is in transit between the backstop 80 and the contact points 20*a* and *b*, the transfer of silver to and from the disk 32 tends to be equalized over an extended period of use. This factor greatly prolongs the useful life of the contactor disk.

Thus, the switch provides high dependability and an extremely long useful life, generally exceeding the life of the internal combustion engine.

I claim:

1. An electrical switch, comprising a casing, a carriage member mounted in said casing for linear movement, a conductive contactor disk mounted on said carriage member for free rotation relative thereto, at least two conductive contacts mounted in said casing opposite said contactor disk for engagement by said disk to complete an electrical circuit between said contacts, spring means acting between said carriage member and said casing for biasing said carriage member in a direction to move said contactor disk out of engagement with said contacts, and a backstop in said casing and engageable by said contactor disk when said contactor disk is moved away from said contacts under the impetus of such spring means, the engagement between said backstop and said contactor disk being effective to prevent rotation of said contactor disk, the engagement between said contactor disk and said contacts also being effective to prevent rotation of said contactor disk, said contactor disk being freely rotatable when in transit between said contacts and said backstop, whereby vibration and other environmental factors cause said contactor disk to rotate relative to said carriage member so that said contactor disk presents fresh surface elements to said contacts during repeated cycles of use.

2. A switch according to claim 1, in which said backstop comprises a wall member in said casing, said wall member having an opening through which said carriage member is movable, said contactor disk being engageable with one side of said wall member, said spring means being connected between said wall member and a portion of said carriage member.

3. A switch according to claim 2, in which said spring means comprises a coil spring mounted around said carriage member, said coil spring having one end engaging said wall member, said carriage member having a shoulder engaging the opposite end of said coil spring.

4. A switch according to claim 3, including a push-button for operating said carriage member against the biasing action of said spring.

5. A switch according to claim 3, including a push-button movably mounted in said casing, and a second spring connected between said push-button and said carriage member for moving said carriage member against the biasing action of the first mentioned spring.

6. A switch according to claim 5, including stop means for limiting the outward movement of said push-button under the biasing action of said springs.

7. A switch according to claim 6, in which said push-button is hollow and includes an opening in which said carriage member is movably received, said second spring taking the form of a coil spring disposed in said opening within said push-button between said push-button and said carriage member.

8. A switch according to claim 7, including a flexible boot connected between said push-button and said casing.

9. An electrical switch, comprising a casing, at least two contact points mounted in said casing, a contactor movable in said casing into and out of engagement with said contact points, said contactor being effective to complete an electrical circuit between said contact points when said contactor engages said contact points, said contact points being made of a metal material composed predominantly of silver, said contactor having a surface portion engageable with said contact points, said contactor being rotatable by vibration and other environmental factors so as to present fresh surface elements to said contact points during repeated cycles of use, whereby the transfer of silver in both directions between said contactor and said contact points tends to be equalized over an extended period of use, and a backstop in said casing and engageable by said contactor when said contactor is moved away from said contact points, said backstop preventing rotation of said contactor, said contactor being prevented from rotating when engaged with said contact points, said contactor being freely rotatable when in transit between said contact points and said backstop.

10. A switch according to claim 9, including spring means for biasing said contactor into engagement with said backstop.

11. An electrical switch, comprising a casing, at least two contact points mounted in said casing, a carriage member mounted in said casing for linear movement, a conductive contactor mounted on said carriage member for free rotation relative thereto, said contactor being movable with said carriage member into and out of engagement with said contact points, said contactor being effective to complete an electrical circuit between said contact points when said contactor engages said contact points, said contact points being made of a metal material composed predominantly of silver, and spring means acting between said carriage member and said casing for biasing said carriage member in one direction of its linear movement, said spring means being out of engagement with said contactor so that said contactor is freely rotatable by vibration and other environmental factors so as to present fresh surface elements to said contact points during repeated cycles of use, whereby the transfer of silver in both directions between said contactor and said contact points tends to be equalized over an extended period of use.

12. An electrical switch, comprising a casing, a carriage member mounted in said casing for linear movement, a conductive contactor mounted on said carriage member for free rotation relative thereto, at least two conductive contacts mounted in said casing on one side of said contactor for engagement by said contactor to complete an electrical circuit between said contacts, a stop in said casing on the opposite side of said contactor from said contacts and engageable by said contactor when said contactor is moved away from said contacts, spring means acting between said carriage member and said casing for biasing said carriage member in one direction of said linear movement, the engagement between said stop and said contactor being effective to prevent rotation of said contactor, the engagement between said contactor and said contacts also being effective to prevent rotation of said contactor, said contactor being freely rotatable when in transit between said contacts and said stop, whereby vibration and other environmental factors cause said contactor to rotate relative to said carriage member so that said contactor presents fresh surface elements to said contacts during repeated cycles of use.

13. A switch according to claim 12, in which said stop comprises a wall member in said casing, said spring means being connected between said wall member and a portion of said carriage member.

14. A switch according to claim 13, in which said spring means comprises a coil spring mounted around said carriage member, said coil spring having one end engaging said wall member, said carriage member having a shoulder engaging the opposite end of said coil spring.

15. A switch according to claim 12, including a push-button for operating said carriage member against the biasing action of said spring means.

16. A switch according to claim 12, including a push-button movably mounted in said casing, and second spring means connected between said push-button and said carriage member for moving said carriage member against the biasing action of the first mentioned spring means.

* * * * *

PO-1050
(5/69)

UNITED STATES PATENT OFFICE
CERTIFICATE OF CORRECTION

Patent No. 3,940,585 Dated March 16, 1976

Inventor(s) William J. Schaad

It is certified that error appears in the above-identified patent and that said Letters Patent are hereby corrected as shown below:

Claim 17 should be added to the patent, as follows:

17. A push-button electrical switch, comprising a casing, a carriage member mounted in said casing for linear movement, a conductive contactor mounted on said carriage member for free rotation relative thereto, at least two conductive contacts mounted in said casing opposite said contactor for engagement by said contactor to complete an electrical circuit between said contacts, first spring means connected between said carriage member and said casing and biasing said carriage member and said contactor away from said contacts, a push-button mounted in said casing for linear movement, and second spring means connected between said push-button and said carriage member for moving said carriage member and said contactor against the biasing action of said first spring means to bring said contactor into engagement with said contacts, said first and second spring means being out of engagement with said contactor to obviate interference by said spring means with the free rotatability of said contactor.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*